US009705257B2

(12) United States Patent
Stimpfl

(10) Patent No.: US 9,705,257 B2
(45) Date of Patent: Jul. 11, 2017

(54) PLUG CONNECTOR PROTECTING AGAINST OVERVOLTAGE DISCHARGE

(71) Applicant: Kurt Stimpfl, Wolfsegg (DE)

(72) Inventor: Kurt Stimpfl, Wolfsegg (DE)

( * ) Notice: Subject to any disclaimer, the term of this patent is extended or adjusted under 35 U.S.C. 154(b) by 486 days.

(21) Appl. No.: 14/075,215

(22) Filed: Nov. 8, 2013

(65) Prior Publication Data

US 2014/0078627 A1 Mar. 20, 2014

Related U.S. Application Data

(63) Continuation of application No. PCT/DE2012/100153, filed on May 22, 2012.

(51) Int. Cl.

| | |
|---|---|
| ***H01R 13/648*** | (2006.01) |
| ***H01R 13/66*** | (2006.01) |
| ***H01R 43/18*** | (2006.01) |
| ***H01R 43/20*** | (2006.01) |
| *H01R 13/46* | (2006.01) |

(52) U.S. Cl.

CPC ..... *H01R 13/6485* (2013.01); *H01R 13/6666* (2013.01); *H01R 43/18* (2013.01); *H01R 43/20* (2013.01); *H01R 13/46* (2013.01); *Y10T 29/49208* (2015.01)

(58) Field of Classification Search

CPC . H01R 13/6485; H01R 13/6666; H01R 43/20
USPC ..... 361/117
See application file for complete search history.

(56) References Cited

U.S. PATENT DOCUMENTS

| | | | | |
|---|---|---|---|---|
| 5,099,380 | A | 3/1992 | Childers | |
| 5,181,864 | A | 1/1993 | Wakino | |
| 5,183,698 | A | 2/1993 | Stephenson | |
| 5,242,311 | A * | 9/1993 | Seong | H01R 13/443 439/135 |
| 5,246,388 | A * | 9/1993 | Collins | H01R 13/6666 361/111 |
| 5,280,467 | A * | 1/1994 | Wanger et al. | 369/275.5 |
| 6,172,590 | B1 | 1/2001 | Shrier | |
| 6,657,532 | B1 * | 12/2003 | Shrier | H01C 7/10 204/205 |
| 6,729,907 | B1 * | 5/2004 | Edenhofer et al. | 439/620.01 |
| 2006/0232370 | A1 | 10/2006 | Ravenelle | |
| 2009/0025213 | A1 * | 1/2009 | Dudnikov, Jr. | H05K 1/0257 29/832 |

FOREIGN PATENT DOCUMENTS

| | | |
|---|---|---|
| DE | 19945426 | 1/2001 |
| EP | 0644612 | 3/1995 |
| GB | 1223139 | 2/1971 |

* cited by examiner

*Primary Examiner* — Scott Bauer
(74) *Attorney, Agent, or Firm* — Themis Law

(57) ABSTRACT

A plug connector for protecting an electrical system, in particular an electronic device, a semiconductor component or cable harness, against overvoltage discharge, includes contact pins embedded in a plastic body, wherein the plastic has an area between the contact pins that exhibits an electrical resistance with an essentially electrically insulating property within an operating range up to a limiting voltage, and further exhibits a diminished electrical resistance above the limiting voltage, allowing a discharge of the overvoltages between the contact pins. A method of manufacturing the plug connector and its use are also disclosed.

9 Claims, No Drawings

PLUG CONNECTOR PROTECTING AGAINST OVERVOLTAGE DISCHARGE

FIELD OF THE INVENTION

The present invention relates to a plug connector for protecting an electrical system against overvoltage discharge, a method for its manufacture as well as its use.

PRIOR ART

Electrical systems, in particular conventional electronics, electronic devices, semiconductor components, cable harnesses and control devices for motor vehicles can be damaged or even completely destroyed by overvoltage discharge. Overvoltage can arise through electrostatic charging during manufacture or fabrication, storage, packaging, processing or connection. The discharge can result in damage or destruction. The electrostatic charge can be generated through friction in the process of handling for packaging purposes or during manufacture, and through the transmission of charges (induction) from machinery, devices and individuals to the electrical systems.

In order to prevent such sensitive electrical systems from becoming damaged by electrostatic discharge, comparatively expensive components that take up installation space are often provided for each contact pin of a plug connector, e.g., capacitors, coils or varistors, in particular on the printed circuit board of an electronic system.

Known from published patent application DE 43 26 486 A1 is a filter plug with a connector-strip body, which is manufactured out of a mixture of insulating material and ferrite powder in order to suppress high-frequency disturbances.

Known from "Elektrisch leitende Kunststoffe" (Electrically Conductive Plastics), Carl Hanser Verlag Munchen Vienna, published by H. J. Mair and S. Roth, page 10, is the application of electrically conductive plastics to avoid the electrostatic charging of housings. Such a housing consists of a plastic-carbon black mixture, and should exhibit a surface resistivity of less than $10^9$ ohm.

European Patent Application EP 0 649 150 A1 relates to a composite that exhibits a filler and a matrix embedding the filler. The filler contains predominantly one component with particles having a core-shell structure. The shells of the particles comprising the shell structure consist of an insulating material, while the cores of these particles are made up of electrically conductive or electrically semiconducting material. Under specific preconditions, the electrical conductivity of this composite cannot undergo a linear change twice during exposure to an electrical field given a suitable selection of material for the core. The first nonlinear change induces a voltage limitation, the second a current limitation.

Published patent application DE 37 02 780 A1 describes a carrier for a semiconductor component, which integrates a device for protecting the varistor against the effects of electromagnetic fields or static charges. The terminals of the semiconductor component to be protected are connected with each other by a sandwich structure. The latter exhibits a first layer comprised of a varistor material, a first electrode connected with a given potential, a second layer of varistor material, as well as a second, grounded electrode.

Known from patent specification U.S. Pat. No. 5,616,881 is a receptacle for the squib of an airbag, which exhibits two chambers. The first chamber accommodates an insert with two pins and a metal oxide varistor to protect an igniter against electrostatic discharge.

DE 199 45 426 C1 describes a plug connector for an electrical device with contact pins, which are embedded in a plastic body exhibiting a material that displays conductive properties at voltages within a range exceeding an operating voltage, and electrically insulating properties at voltages within the operating voltage range. A polymer mixture based on propylene with carbon powder is disclosed as a suitable material with good conductivity upon reaching a breakdown voltage. This plug connector is to be easy to manufacture from a production standpoint, and exhibit no protection against electrostatic discharge that would take up installation space.

However, the disadvantage is that a technologically complex material comprised of a mixture of plastic and carbon powder must be used.

SUMMARY OF THE INVENTION

Therefore, the object of the present invention is to eliminate the disadvantages from prior art. To be provided is a plug connector for protecting an electrical system against overvoltage discharge that is even easier to manufacture and also exhibits no additional devices for protecting against electrostatic discharge that would take up installation space, a further simplified method for manufacturing such a plug connector, as well as an improved use of the latter.

The above object is achieved by the plug connector as disclosed hereinafter for protecting an electrical system against overvoltage discharge. The plug connector encompasses contact pins that are embedded in a plastic body. The plastic has an area between the contact pins that (a) exhibits an electrical resistance with an essentially electrically insulating property within an operating range up to a limiting voltage, and (b) exhibits a diminished electrical resistance above the limiting voltage, allowing the overvoltages between the contact pins to discharge.

Additional advantageous embodiments are also disclosed herein.

DETAILED DESCRIPTION OF EMBODIMENTS OF THE INVENTION

As opposed to the prior art, the plug connector according to the invention can be easily manufactured out of a commercially available plug connector that encompasses contact pins embedded in a plastic body, wherein the plastic body of the commercially available plug connector essentially represents an electrical insulator, whose electrical resistance usually measures essentially at least 2 GΩ, preferably at least 30 GΩ, especially preferably at least 200 GΩ. In other words, it is not necessary to use a varistor material, for example a mixture of plastic and carbon powder, as had been required in prior art.

A plug connector according to the invention exhibits at least two contact pins or pins, but can also have significantly more, up to 200.

The advantage to the plug connector according to the invention is that it exhibits an electrical resistance with an essentially electrically insulating property within an operating range up to a limiting voltage, and thereby protects an electrical system against overvoltage discharge with an improved reliability. For example, the electrical resistance in this range can measure at least 2 GΩ, preferably at least 30 KΩ, especially preferably at least 200 KΩ.

The limiting voltage can measure between 60 and 1100 V, preferably between 250 and 350 V, especially preferably between 270 and 310 V, and very much especially preferably measure 275 V.

Above the limiting voltage, the plastic of the plug connector according to the invention exhibits an area between at least two contact pins having a diminished electrical resistance, which allows overvoltages to be discharged between the contact pins. This area can lie above the limiting voltage for a diminished electrical resistance of less than 20 GΩ, preferably less than 200 KΩ, especially preferably less than 60 KΩ.

The plastic of the plug connector according to the invention can be thermoset or thermoplastic, which is preferably reinforced, especially preferably glass-fiber reinforced.

In a preferred embodiment, the plastic of the plug connector encompasses polyethylene or polypropylene. It is especially preferred that it be reinforced with glass fibers up to 50%, especially preferably up to 30%, by weight.

The described area described can exhibit a layer thickness of 0.05 to 0.2 mm, preferably of 0.1 mm. The thickness can be controlled by the amount of energy supplied in the manufacturing method according to the invention, i.e., by way of the voltage, current strength and duration of exposure to current.

A method according to the invention for manufacturing a plug connector according to the invention specifically encompasses the following steps: in a plug connector with contact pins embedded in a plastic body, wherein the plastic exhibits an essentially electrically insulating property, an electrical current is applied to the area between two contact pins with a time-variable voltage source, for example a function generator or arbitrary generator, via a current-limiting element, e.g., an ohmic resistor or capacitor), thereby causing the electrical resistance to diminish in this area. This injects a current flow into the plastic body between the two contact pins.

The voltage source used can be a DC supply, an AC supply or a time-variable power source, e.g., an arbitrary waveform generator. When using a DC supply, the current supply must be interrupted again and again. An AC supply is thus preferred, since the current flow is stopped when the voltage progression crosses zero.

In a preferred embodiment, use is made of an alternating current with a voltage of 1 to 10 kV, preferably 5 to 6 kV, a current intensity of 5 to 50 mA, preferably 10 to 20 mA, and a frequency of 50 Hz to 200 kHz, preferably 1 kHz to 5 kHz, especially preferably 100 Hz to 150 Hz.

Another advantage to the plug connector according to the invention is that an electrostatic discharge can be prevented directly on vulnerable components even under unfavorable spatial conditions, since no additional space is required for components. No added costs are incurred for components, placement, printed circuit board surface, layout or other structural design-related outlays.

The plug connector according to the invention is suitable for protecting electrical systems, in particular electronic devices, semiconductor elements and cable harnesses, against overvoltage discharges.

The plug connector according to the invention is also suitable for electrical squibs, which trigger an airbag or seat belt tightening system in a motor vehicle.

Especially preferred embodiments of the invention will now be described based on examples.

EXAMPLE 1

On a plug connector with 100 contact pins embedded in a plastic body, wherein the polypropylene-based plastic is reinforced with 30% by weight of glass fibers and has an electrical resistance of 200 GΩ, a sinusoidal electrical alternating current with a voltage of 5 kV, frequency of 100 kHz and current intensity of 10 mA is applied to the area between the contact pins between two contact pins with a time-variable power source by way of a series resistor with 600 kΩ, so that the electrical resistance in this area diminishes to 28 MΩ at about 30 V, and a plug connector according to the invention is obtained. At a voltage in excess of 30 V, the resistance decreases to about 27.5 kΩ (Zener effect).

EXAMPLE 2

A plug connector is manufactured as in Example 1, but 6 kV of voltage are applied in contrast to Example 1. The area generated between the contact pins exhibits a layer thickness of 0.1 mm. The diminished electrical resistance in the area measures 28 kΩ.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

The invention claimed is:

1. A method of manufacturing a plug comprising the following steps:

embedding contact pins in a body of plastic without conductive additives therein, wherein the plastic exhibits an essentially electrically insulating property; and applying an electrical current between two contact pins by applying a time-variable voltage source to an area between the contact pins having a layer thickness between 0.05 and 0.2 mm over a series resistor to cause electrical resistance to diminish to less than 20 GΩ above a limiting voltage between 60 and 1100 V in the area between the contact pins.

2. The method according to claim 1, wherein the current is applied with a voltage of 1 to 10 kV, a current intensity of 5 to 50 mA, and a frequency of 50 Hz to 200 kHz.

3. The method according to claim 2, wherein the current is applied with a voltage of 5 to 6 kV.

4. The method according to claim 2, wherein the current is applied with a current intensity of 10 to 20 mA.

5. The method according to claim 2, wherein the current is applied with a frequency of 1 kHz to 5 kHz.

6. The method according to claim 1, wherein the current is applied with a voltage of 5 to 6 kV, a current intensity of 5 to 50 mA, and a frequency of 50 Hz to 200 kHz.

7. The method according to claim 1, wherein the layer thickness is 1 mm.

8. The method according to claim 1, wherein the electrical resistance is caused to diminish to less than 200 kΩ.

9. The method according to claim 1, wherein the electrical resistance is caused to diminish to less than 60 kΩ.

* * * * *